United States Patent [19]

Aoki et al.

[11] 4,324,960

[45] Apr. 13, 1982

[54] WINDMILL-SHAPED ELECTRODE FOR VACUUM CIRCUIT INTERRUPTER

[75] Inventors: Shin-Ichi Aoki; Yasushi Takeya, both of Amagasaki, Japan

[73] Assignee: Mitsubishi Denki Kabushiki Kaisha, Tokyo, Japan

[21] Appl. No.: 68,102

[22] Filed: Aug. 20, 1979

[30] Foreign Application Priority Data

Aug. 25, 1978 [JP] Japan ..... 53-104013

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,949,520 | 8/1960 | Schneider | 200/144 B |
| 3,008,022 | 11/1961 | Lee | 200/144 B |
| 3,158,719 | 11/1964 | Polinko et al. | 200/144 B |
| 3,185,797 | 5/1965 | Porter | 200/144 B |
| 3,280,286 | 10/1966 | Ranheim | 200/144 B |
| 3,327,081 | 6/1967 | Pflanz | 200/144 B |
| 3,462,572 | 8/1969 | Sofianek | 200/144 B |
| 3,522,399 | 7/1970 | Crouch | 200/144 B |

*Primary Examiner*—Robert S. Macon

*Attorney, Agent, or Firm*—Wenderoth, Lind & Ponack

[57] ABSTRACT

The disclosed windmill-shaped electrode comprises a central circular flat portion, a tapered portion connected to the central flat portion to encircle it and four circular arc-shaped slots extending radially and circumferential through the tapered portion and terminating at the flat portion. The flat portion has a radius not smaller than 0.4 time and not larger than 0.7 time a maximum radius of the electrode. Each slot describes a circular arc having a single radius not smaller than the radius of the flat portion.

6 Claims, 3 Drawing Figures

WINDMILL-SHAPED ELECTRODE FOR VACUUM CIRCUIT INTERRUPTER

BACKGROUND OF THE INVENTION

This invention relates to improvements in a windmill-shaped electrode used with vacuum circuit interrupters.

Vacuum circuit interrupters are now becoming important in the field of AC high voltage circuit interrupters and include generally a magnetic drive type electrode which is called a windmill-shaped electrode. Among the various excellent features thereof vacuum circuit interrupters have the important merit that they can be made small-sized. However it can not be said that vacuum circuit interrupters with a rated interrupted current value in excess of 40 kiloamperes are sufficiently small-sized as compared with conventional oil circuit interrupters having a small amount of oil and conventional gas-blast circuit interrupters utilizing gaseous sulfur hexafluoride ($SF_6$). Particularly, the interrupting portion thereof which has a large diameter has been one of impediments in the increased use of vacuum circuit interrupters in the field of high current capacities. On the other hand, vacuum circuit interrupters are still expensive among small-sized circuit interrupters having a rated interrupted current value on the order of 8 kiloamperes and a fairly large proportion of this is attributable to the windmill-shaped electrode disposed in such circuit interrupters.

The windmill-shaped electrode used in vacuum circuit interrupters includes the central circular flat portion having a contact function and a tapered portion surrounding the central flat portion which is windmill-shaped and having a plurality of circular arc-shaped slots radially and circumferentially extending therethrough thereby to drive magnetically an electric arc which strikes the electrode.

For conventional windmill-shaped electrodes there has not yet been established an approach to their design geometry such as the radius of curvature of and angle subtended by the circular arc-shaped slots at the centers thereof, the number and width of the slots and the shape of the tips of the blades forming the windmill etc. Accordingly, the entire surface of such windmill-shaped electrodes has not been effectively put to practical use for achieving the interruption of current and therefore the interrupting current to which can be interrupted has been comparatively low although the electrodes have a comparatively large maximum radius. For example, since the circular arc-shaped slot has been too small has too large a radius of curvature, the circumferential or radial length thereof has been insufficient and causes the magnetic driving effect to be excessively small or deficient. This might selectively melt the tips of the windmill portion or the central flat portion of the windmill-shaped electrodes thereby to make it impossible to interrupt the particular current. Also, because the circular arc-shaped slots have been, for example, excessively narrow in width, a portion or portions of the electrode melted at the time of interruption might electrically shortcircuit the slot or slots resulting in a failure to interrupt the current involved. On the contrary, when the slot width is large enough to cause the surface area of the windmill-shaped portion to be insufficient, this might also result in a decrease in interrupting capacity. Further, because the blades forming the windmill have an excessively large weight, it has been required to increase the mechanical strength of the root of each blade. Consequently, a thicker structure has inevitably resulted. Thus conventional windmill-shaped electrodes have been so complicated in structure that, for example, each of the circular arc-shaped slots might be formed of a plurality of circular arcs having different radii of curvature and/or different centers and merged into one another. Further the electrodes have been thick. Accordingly, windmill-shaped electrodes of the conventional construction have been disadvantageous in that the circular arc-shaped slots can not be easily machined, the wear and tear on the machine tools for machining such slots are severe and the machining time is long.

Accordingly, it is an object of the present invention to provide a new and improved windmill-shaped electrode permitting the resulting vacuum circuit interrupter to be small-sized.

It is another object of the invention to reduce the cost of vacuum circuit interrupters by provision of a new and improved windmill-shaped electrode which is easy to machine.

SUMMARY OF THE INVENTION

The present invention provides a windmill-shaped electrode used with a vacuum circuit interrupter comprising a central flat portion having the contacting function, a tapered portion disposed around the central flat portion and having the current interrupting function, the flat and tapered portions being formed of a common material, and a plurality of circular arc-shaped slots extending through the tapered portion and terminating at the flat portion, the circular arc-shaped slots having the function of magnetically driving an electric arc, the flat portion having a radius not smaller than 0.4 times and not larger than 0.7 times the maximum radius of the windmill-shaped electrode, each of the circular arc-shaped slots being a simple circular arc having a single radius of curvature not smaller than the radius of the flat portion.

Preferably, the sum of the respective effective angles subtended by the plurality of circular arc-shaped slots at their centers respectively may be at least 360 degrees and the sum of the effective lengths of the plurality of circular arc-shaped slots is not smaller than twice the maximum radius of the windmill-shaped electrode.

Also the sum of the respective effective angles subtended by those portions of the plurality of circular arc-shaped slots extending through the tapered portion and at their centers respectively may be at least 180 degrees and the sum of effective lengths of said portions of the plurality of circular arc-shaped slots is not smaller than the maximum radius of the windmill-shaped electrode.

BRIEF DESCRIPTION OF THE DRAWINGS

The present invention will become more readily apparent from the following detailed description taken in conjunction with the accompanying drawing in which.

DESCRIPTION OF THE PREFERRED EMBODIMENTS

The present invention contemplates eliminating the disadvantages of the prior art practice as described above. In order to find the optimum geometry of windmill-shaped electrodes having a surface area capable of being effectively put to the greatest use with respect to an electric arc due to a particular interrupting current, tests of interrupting shortcircuit currents have been conducted with windmill-shaped electrodes having different parameters and the electrodes after the tests have been observed. The present invention is based on the results of those tests and observations and provides a windmill-shaped electrode for vacuum circuit interrupters which has a small diameter and is capable of being economically manufactured. Simultaneously, the present invention contemplates reducing the inter-phase distance in multiphase vacuum circuit interrupters and reducing the weight thereof as a whole by assembling the electrode of the present invention thereinto.

Figure 1:
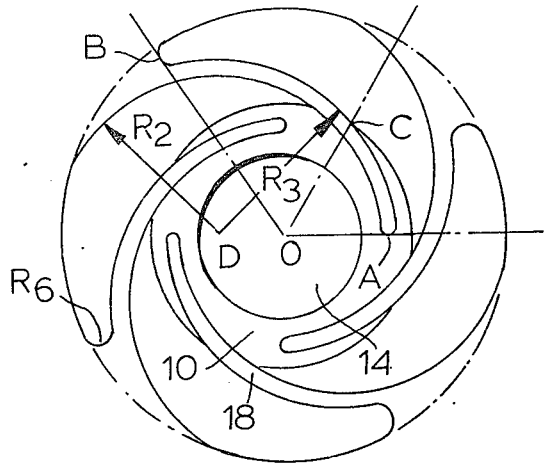
FIG. 1 is a top plan view of one embodiment of the windmill-shaped electrode according to the present invention.
Figure 2:
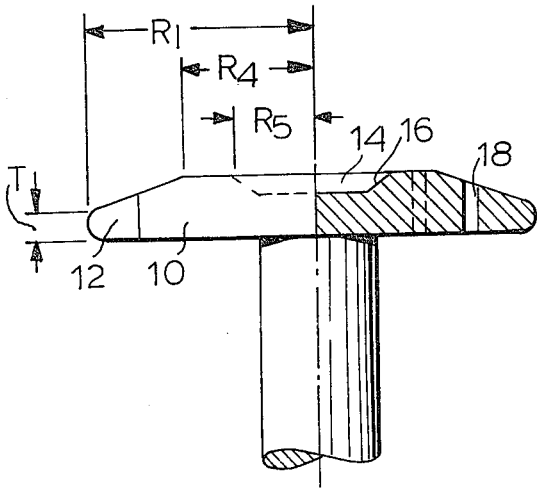
FIG. 2 is a side elevational view, partly in cross section, of the electrode shown in FIG. 1.

Referring now to FIGS. 1 and 2, there is illustrated one embodiment of the windmill-shaped electrode of the present invention. In the arrangement illustrated, the windmill-shaped electrode is in the form of a disc having a frustoconical cross section and includes a central circular flat portion 10 and a tapered portion 12 integral with and encircling the central flat portion 10. The central circular flat portion 10 includes a central circular recess 14 concentric therewith, leaving an annular land zone therearound. The recess 14 has a bottom extending from the annular land zone through a transition wall 16 flared toward the land zone for a purpose which will be apparent hereinafter. The tapered portion 12 terminates in a circular bottom as best shown in FIG. 2.

As best shown in FIG. 1, a plurality of slots 18, in this case, four slots, extend radially and circumferentially at substantially equal angular intervals through the tapered portion 12 along similar circular arcs until the slots 18 terminate at points A located at substantially equal angular intervals on the annular land zone of the central flat portion 10 and on a circular concentric with the latter. The circular arc-shaped slots 18 open at substantially equal angular intervals on the peripheral edge of the tapered portion 12. Therefore the tapered portion 12 and the adjacent part of the flat portion 10 are divided into a plurality of blades, in this case four blades, by the four circular arc-shaped slots 18 to make the electrode windmill-shaped.

As shown in FIG. 1, each of the circular arc-shaped slots 18 is defined by both a radially inner circular arc-shaped wall and a radially outer circular arc-shaped wall opposite to and uniformly spaced from the latter. That portion of the radially inner circular arc-shaped wall defining the open end portion of each slots 18 is merged into the circular peripheral edge of the mating blade while the opposite portion of the radially outer wall is merged into the peripheral edge of the adjacent blade by a round tip B. The radially outer circular arc-shaped wall intersects the boundary between the flat and tapered portions 10 and 12 respectively at a point C.

As described above, the central flat portion 10 performs the contact function and the tapered portion 12 performs the current interrupting function while the circular arc-shaped slots 18 serve to drive magnetically radially outward of the electrode an electric arc striking the electrode.

For a given value of a maximum radius R1 (see FIG. 2) of the windmill-shaped electrode, there are substantially unlimited numbers of ways of selecting radii of curvature of the circular arcs along which the radially inner and outer walls of the circular arc-shaped slots 18 extend. However, for the purpose of simplifying the description and from the standpoint that the machining is facilitated, it is preferably that the each slot 18 have a uniform width and the radially inner and outer walls respectively lie along a simple circular arc having the center D and a single radius of curvature R2 and another circular arc having the same center D and a radius of curvature R3 and that the circular arc for the radially inner wall be inscribed in a circle defined by a maximum radius R1 of the electrode while the circular arc for the radially outer wall passes through the points A, C and B as shown in FIG. 1 and has an effective arc length $\overline{ACB}$.

A multiplicity of windmill-shaped electrodes such as shown in FIGS. 1 and 2 have been produced having different details of structure from one another and undergone shortcircuit and interruption tests. The tested electrodes have been investigated according to a series of experimental schemes for inspecting and observing the trace of electric arcs striking the surface of the tested electrodes. The result of the investigation has been considered in conjunction with dimensions of the details of the electrode structure normalized with the maximum radius R1 of the electrode. As a result, it has been found that not only the normalized structural dimensions are pertinent to the interrupting performance but also the absolute values of some parameters are required to enable the windmill-shaped electrode to have an excellent interrupting performance. The principal results of this consideration will now be described.

(1) To the extent that the circular arc-shaped slots 18 are partly disposed in the central flat portion 10, that is, to the extent that the slots 18 include one portion designated by a circular arc $\overline{AC}$, the greater the radius of curvature R2 and therefore R3 of the circular arc-shaped slots 18 the more the interrupting performance will be enhanced. However, if the radius of curvature R2 and therefore R3 becomes too large then the interrupting performance is caused to deteriorate abruptly for the following reasons: A radial component of the circular arc-shaped slot relative to the electrode becomes too small to weaken very much the force for driving an electric arc magnetically and ultimately the circular arc-shaped slots do not reach the central flat portion 10.

Figure 3:
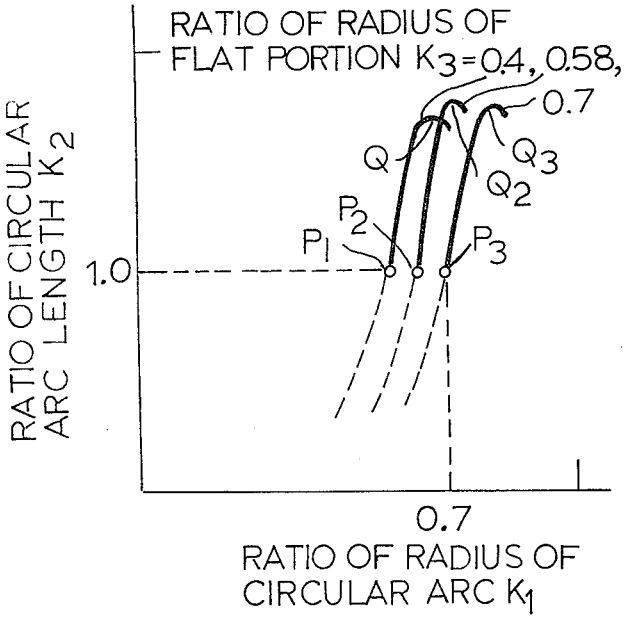
FIG. 3 is a graph illustrating the relationship among the length of each circular arc-shaped slot shown in FIGS. 1 and 2, the radius of curvature thereof and the radius of the flat portion shown in FIGS. 1 and 2, with all dimensions normalized with a maximum radius of the electrode.

FIG. 3 shows the relationship between the radius of curvature R2 of the radially inner circular arc for the circular arc-shaped slot 18 normalized with the maximum radius R1 of the electrode or a ratio K1 therebetween (which is plotted on the abscissa) and the arc length of the slot 18 normalized with the radius R1 or a ratio K2 therebetween (which is plotted on the ordinate) with the parameter being the outside radius R4 of the flat portion 10 normalized with the maximum diameter of the electrode or a ratio K3 therebetween. The graph has been obtained by drawing figures.

As shown in FIG. 1, each slot 18 has an arc length defined by a pair of radii extending from the center O of the electrode and passing through points A and B respectively and designated by the reference characters $\overline{ACB}$ while that portion of each slot 18 extending through the tapered portion 12 alone has an arc length $\overline{BC}$ defined by a pair of radii extending from the center O and passing through the points B and C.

From FIG. 3, it is seen that the ratio K2 of the arc length is rapidly increased as the ratio K1 is increased until it reaches a maximum at a certain value of the ratio K1 as designated by the reference character Q1, Q2 or Q3. This closely resembles the relationship between the ratio K1 and the interrupting performance and therefore it has been found that the longer the arc length $\overline{ACB}$ the more the interrupting performance will be improved. It has been found also that the arc length $\overline{ACB}$ should not be smaller than the maximum radius R1 of the electrode.

(2) Further it has been found that the outside radius R4 of the flat portion 10 normalized with the maximum radius R1 of the electrode or the ratio K3 therebetween is one of the important structural parameters. More specifically, the condition that the arc length $\overline{ACB}$ of the circular arc-shaped slot 18 be larger than the maximum radius R1 of the electrode is fulfilled when the ratio K3 ranges from 0.4 to 0.7 as shown in FIG. 3. In FIG. 3 the arc length $\overline{ACB}$ is shown as having substantially equal maxima at the values of K3 of 0.4, 0.58 and 0.7 as designated by the reference characters Q1, Q2 and Q3.

If the ratio K3 has a value smaller than 0.4 then the maximum of the arc length $\overline{ACB}$ decreases so that the ratio K1 of the radius of curvature R2 becomes small at the maximum of the arc length $\overline{ACB}$. Accordingly, the interrupting performance is abruptly lowered.

On the other hand, if the ratio K3 of the outside radius R4 of the flat portion 10 exceeds 0.7 then an electric arc due to an interrupted current has an initiation point located outside of the central flat portion 10. Alternatively, that portion of the circular arc-shaped slots extending through the tapered portion 12 may have an excessively short arc length $\overline{BC}$. This gives rise to a deterioration of the interrupting performance.

(3) From the foregoing items (1) and (2) it is seen that the optimum condition that the circular arc-shaped slot 18 should have an arc length $\overline{ACB}$ not smaller than the maximum radius R1 of the electrode must limit the radius of curvature R2 of the radially inner circular arc for the circular arc-shaped slot so that it is no smaller than the outside radius R4 of the flat portion 10.

(4) The arc length $\overline{BC}$ of the circular arc-shaped slots in the tapered portion 12 is also important. In order to make the interrupting performance good, it is required that the arc length $\overline{BC}$ be no smaller than one half the maximum radius R1 of the electrode. For a given value of the outside radius R4 of the flat portion 10, a decrease in radius R2 and therefore R3 of the circular arc-shaped slot causes particularly a reduction in arc length $\overline{BC}$ of the slot in the tapered portion 12. This may result in great deterioration of the interrupting performance for some interruptions.

(5) The central flat portion 10 has an inside radius R5. If the circular arc-shaped slots 18 have a radius of curvature R2 and therefore a small radius of curvature R3 then there is a fear that the termination points A of the circular arc-shaped slots will go beyond the inside radius R5 of the central flat portion 10. Alternatively, the termination points A may be located short of the inside radius R5 to leave small spaces therebetween so that the points A do not go beyond the inside radius R5. Under these circumstances, when an electric arc strikes the electrode its foot is apt to be at any one of those small spacings. Therefore an extraordinary rise in temperature occurs locally in the electrode. This may result in the interruption being discontinued. In order to avoid this objection, it has been found that the small spacing is required to have a radial dimension of at least 2 millimeters. Also, in order to increase the local heat capacity of the electrodes at the small spacing, it is desirable to connect the recess 14 to the annular land zone of the flat portion 10 through the flared transition wall 16 as described above (see FIG. 2).

(6) If the tip B of each blade of the windmill has insufficient heat capacity, then there is a danger that it will not be able to interrupt the particular current. It has been experimentally found that the tip B is required to have a radius of curvature R6 (see FIG. 1) no smaller than 2 millimeters and a thickness (see FIG. 2) of at least 4 millimeters.

(7) Furthermore it has been found that, the circular arc-shaped slots 18 are required to have a slot width no smaller than 1.5 millimeters with for vacuum circuit interrupters having the rated interrupting current of 8 kiloamperes or more.

From FIG. 3 it has been found that the optimum interrupting performance is developed within a region located to the left of the maximum point Q1, Q2 or Q3 of the arc length and at and above a lower point P1, P2 or P3 of the arc length equal to the maximum radius R1 of the electrode. Within that region the circular arc-shaped slots have the proper arc length while the radial and circumferential components of the circular arc for the circular arc-shaped slot are proper as viewed from the center of the electrode. As a result, it is considered that any electric arc striking the electrode will most effectively undergo the self-magnetic driving action.

Furthermore, in the windmill-shaped electrode as shown in FIGS. 1 and 2, the sum of the effective angles subtended by the respective circular arc-shaped slots 18 at their centers is at least 360 degrees and the sum of the effective arc length of the slots is no smaller than twice the maximum radius R1 of the electrode. Also the sum of the effective angles subtended by those portions of the respective circular arc-shaped slots extending through the tapered portion 12 alone and at their centers is at least 180 degrees and the sum of the effective arc lengths of the portions of the respective slots 18 as described above is no smaller than the maximum radius R1 of the electrode. 180 degrees and the sum of the effective lengths thereof is no less than the maximum radius R1 of the electrode.

A multiplicity of conducted experiments have been analyzed and the results of the analysis have been described in conjuncton with FIGS. 1, 2 and 3, but the number of blades forming the windmill for the electrode, or of the circular arc-shaped slots may be varied as desired. However, it has been found that, in view of the economy with which the circular arc-shaped slots are machined, the number of those slots may be decreased as much as possible while the effective arc length $\overline{ACB}$ of the slot is increased thereby to increase the total of the effective lengths of the slots, that is, the product of the effective length of each of the slots multiplied by the number thereof. Also it has been found that, by constructing a windmill-shaped electrode including no local portion having a low heat capacity, the entire area of the surface thereof can be effectively put to practical use in the optimum manner in order to interrupt a current involved.

From the foregoing it has been seen that, by selecting the optimum structure thereof, the windmill-shaped electrode can be made small-sized so that the radius is reduced to one half that of conventional windmill-shaped electrodes or less. In the so-called integrated windmill-shaped electrodes including the flat portion having the contacting function and the tapered portion formed into a unitary structure of a common material, this decrease in electrode radius is particularly important not only because the material is expensive but also because it contributes to the economy with which the circular arc-shaped slots of the windmill are machined. A decrease in electrode radius is more importantly advantageous in that, upon assembling the windmill-shaped electrode of the present invention into multiphase vacuum circuit interrupters, the inter-phase distance can be further shortened thereby to permit the overall structure of vacuum circuit interrupters to be made smaller.

While the present invention has been described in conjunction with a few preferred embodiments thereof it is to be understood that numerous changes and modifications may be resorted to without departing from the spirit and scope of the present invention.

What we claim is:

1. A windmill-shaped electrode for use with a vacuum circuit interrupter, comprising:

a circular central flat portion for receiving the arc of the interrupted current and having a central axis of rotation, and a tapered portion around the central flat portion and integral therewith for interrupting the current, the flat and tapered portions being of a common material, said electrode having a plurality of circular arc-shaped slots extending through the electrode in the direction parallel to the axis of rotation and curving inwardly from the periphery of the tapered portion and terminating in the central flat portion for magnetically driving an electric arc, the flat portion having a radius no smaller than 0.4 times and no larger than 0.7 times the maximum radius of the windmill-shaped electrode, each of the circular arc-shaped slots being in the shape of a simple circular arc having a single radius of curvature no smaller than the radius of the flat portion.

2. A windmill-shaped electrode as claimed in claim 1 wherein the sum of the angles subtended by the plurality of circular arc-shaped slots at the respective centers of curvature thereof is at least 360 degrees, and the sum of the arc lengths of the circular arc-shaped slots is no smaller than twice the maximum radius of the windmill-shaped electrode.

3. A windmill-shaped electrode as claimed in claim 1 wherein the sum of the angles subtended by those portions of the plurality of circular arc-shaped slots extending through the tapered portion and at the respective centers of curvature thereof is at least 180 degrees and the sum of effective lengths of said portions of the plurality of circular arc-shaped slots is no smaller than the maximum radius of the windmill-shaped electrode.

4. A windmill-shaped electrode as claimed in claim 1 wherein each of the circular arc-shaped slots has a radially inner wall lying along a circular arc inscribed in a circle determined by the maximum radius of the windmill-shaped electrode and a radially outer wall lying along a circular arc concentric with the radially inner wall.

5. A windmill-shaped electrode as claimed in claim 1 wherein each of the circular arc-shaped slots has a width of at least 1.5 millimeters.

6. A windmill-shaped electrode as claimed in claim 1 wherein adjacent pairs of slots define blades therebetween forming the windmill of the electrode, and each blade has a rounded tip having a radius of curvature of at least 2 millimeters and said tapered portion has a thickness of at least 4 millimeters at said tips.

* * * * *